United States Patent [19]

Inui et al.

[11] 4,215,292

[45] Jul. 29, 1980

[54] APPARATUS FOR OPERATING A GASEOUS DISCHARGE LAMP

[75] Inventors: Kenichi Inui, Yokohama; Hisao Kobayashi, Fujisawa; Nanjou Aoike, Yokohama, all of Japan

[73] Assignee: Toshiba Electric Equipment Corporation, Tokyo, Japan

[21] Appl. No.: 18,262

[22] Filed: Mar. 7, 1979

[30] Foreign Application Priority Data

Apr. 26, 1978 [JP] Japan ..... 53/48705

[51] Int. Cl.[2] ..... H05B 41/29; H05B 41/42

[52] U.S. Cl. ..... 315/98; 315/102; 315/DIG. 5; 315/DIG. 7

[58] Field of Search ..... 315/98, 102, DIG. 5, 315/DIG. 7

[56] References Cited

U.S. PATENT DOCUMENTS

| | | | |
|---|---|---|---|
| 3,119,048 | 1/1964 | Tsuchiya | 315/206 X |
| 3,389,299 | 6/1968 | Bell | 315/98 X |
| 4,127,797 | 11/1978 | Perper | 315/DIG. 5 |
| 4,150,323 | 4/1979 | Yeh et al. | 315/DIG. 5 |

*Primary Examiner*—Alfred E. Smith
*Assistant Examiner*—Charles F. Roberts
*Attorney, Agent, or Firm*—Oblon, Fisher, Spivak, McClelland & Maier

[57] ABSTRACT

An apparatus for operating a gaseous discharge lamp comprises a D.C. power source, a transistor inverter which is connected to the D.C. power source through a switch, provided with at least one inverter transistor and generates an output having a prescribed frequency, and a discharge lamp which is energized by an output from the transistor inverter and having a pair of electrodes heated by part of the output. The apparatus further comprises base current control means which holds the base current of the inverter transistor at a level lower than a first level during a prescribed length of time after the close of the switch, and holds the base current at the first level after the prescribed length of time. The discharge lamp has its electrodes preheated, but does not display discharge when the base current has a level lower than the first level, and commences discharge when the base current reaches the first level and thereafter continues discharge.

11 Claims, 6 Drawing Figures

APPARATUS FOR OPERATING A GASEOUS DISCHARGE LAMP

BACKGROUND OF THE INVENTION

This invention relates to an apparatus for operating a discharge lamp by applying a transistor inverter.

A known apparatus for operating a discharge lamp is also provided with a transistor inverter. With the prior art apparatus, power supplied from a D.C. source is converted by a transistor inverter into A.C. power having a frequency ranging from several KHz to scores of KHz. This A.C. power actuates a discharge lamp. In this case, part of the A.C. power heats a pair of electrodes received in the discharge lamp. In this case, high frequency A.C. voltage is impressed across the paired electrodes at the commencement of their heating. In other words, the conventional discharge lamp operating apparatus has such arrangement that high voltage is supplied to the paired electrodes, before they are fully preheated. Consequently, the electrodes are damaged in a relatively short time, unavoidably resulting in the short effective life of a discharge lamp. Particularly where a discharge lamp is started and operated on a full scale by the aforesaid high frequency power, a start voltage applied across the paired electrodes should have a higher level than when the discharge lamp is started and put into full operation by power having a commercially specified frequency. As a result, the electrodes are noticeably depleted.

It is accordingly the object of this invention to provide an apparatus for operating a discharge lamp, which makes it possible to apply a lower voltage than required in the past across the paired electrodes during a prescribed period in which the electrodes are preheated.

SUMMARY OF THE INVENTION

An apparatus embodying this invention which operates a discharge lamp comprises a D.C. power source; a transistor inverter which is provided with input terminals connected to the D.C. power source through a switch, an output transformer and at least one inverter transistor, the collector-emitter circuit of the inverter transistor being connected between one end of the primary winding of the output transformer and one of the input terminals of the transistor inverter; a discharge lamp energized by an output from the output transformer and provided with a pair of electrodes heated by part of the output; and base current control means which is coupled to the transistor inverter and holds the base current of the inverter transistor at a level lower than a first level capable of starting the discharge lamp by an output from the transformer for a specified length of time after the switch is closed, and, after lapse of the specified length of time, holds the base current of the inverter transistor at the first level.

DETAILED DESCRIPTION OF THE PREFERRED EMBODIMENTS

Figure 1:
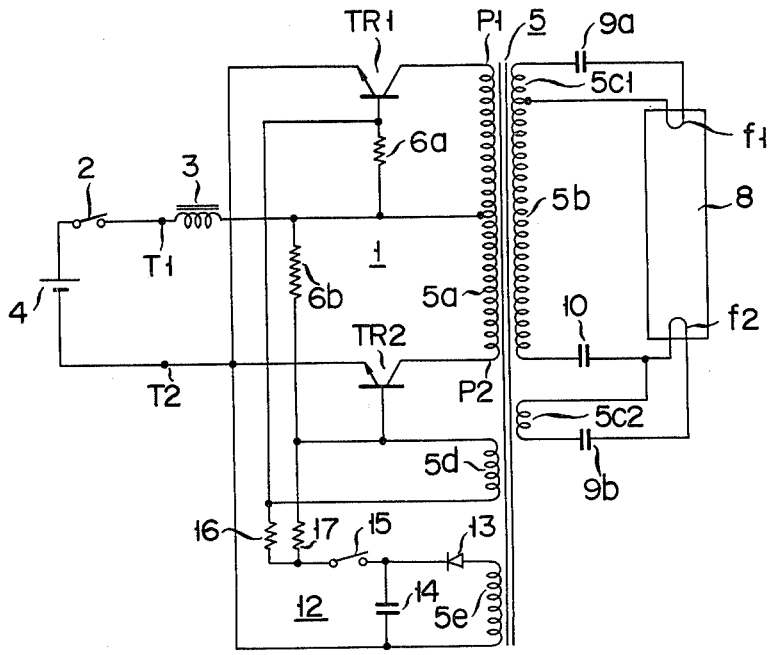
FIGS. 1 to 6 indicate the circuit arrangements of the first to sixth embodiments of this invention.

Referring to the first embodiment of FIG. 1, the input terminals T1, T2 of a push-pull type transistor inverter 1 are connected to the corresponding output terminals of a D.C. power source 4 through a switch 2 and constant current inductor 3. The transistor inverter 1 comprises NPN transistors TR1 and TR2 and output transformer 5. This output transformer 5 is provided with a primary winding 5*a* and secondary windings 5*b*, 5*c*1, 5*c*2 and 5*d*. The input terminal T1 is connected to a midpoint on the primary winding 5*a*. The base-emitter circuit of the transistor TR1 is connected between the input terminals T1 and T2 through a base resistor 6*a* and the inductor 3. The emitter of the transistor TR1 is connected to the input terminal T2, and the collector thereof is connected to one end P1 of the primary winding 5*a*. The base-emitter circuit of the transistor TR2 is connected between the input terminals T1 and T2 through a base resistor 6*b* and the inductor 3. The emitter of the transistor TR2 is connected to the input terminal T2, and the collector thereof is connected to the other end P2 of the primary winding 5*a*. One electrode f1 of a discharge lamp 8 is connected between the ends of the secondary winding 5*c*1 through a current limiting capacitor 9*a*, and the other electrode f2 is connected between the ends of the secondary winding 5*c*2 through a current limiting capacitor 9*b*. The electrode f1 is connected to one end of the secondary winding 5*b*, and the electrode f2 is connected to the other end of the secondary winding 5*b* through a current limiting capacitor 10. The secondary winding 5*d* used to feedback an output from the transistor inverted I to the bases of the transistors TR1 and TR2. One end of the secondary winding 5*d* is connected to the base of the transistor TR1, and the other end thereof is connected to the base of the transistor TR2. The base resistors 6*a* and 6*b* are chosen to have such a resistance as allows the transistors TR1 and TR2 to be supplied with a base current which does not effect the start and lighting of the discharge lamp 8, even when the switch 2 is closed. The base current supplied from the secondary winding 5*d* to the transistors TR1 and TR2 is used simply to control the switching operation of the transistors TR1 and TR2 in accordance with the frequency of an output from the inverter 1 and does not have a sufficient level to carry out the start and lighting of the discharge lamp 8. A circuit 12 for controlling the base current of the transistors TR1 and TR2 comprises a secondary winding 5*e* provided for the transformer 5, a diode 13 for rectifying an output from the secondary winding 5*e*, a capacitor 14 for smoothing an output from the diode 13, and a switch 15 for supplying the smoothed output as base current to the transistors TR1 and TR2. When the switch 15 is closed, an output from the diode 13 is conducted to the base-emitter circuit of the transistor TR1 through a resistor 16 and also to the base-emitter circuit of the transistor TR2 through a resistor 17.

There will now be described the operation of the apparatus shown in FIG. 1. When the switch 2 is thrown in, the transistor inverter 1 begins to be operated, causing the transformer 5 to produce an output having a prescribed high frequency. At this time, the electrodes f1 and f2 are preheated by part of the high frequency output. The bases of the transistors TR1 and TR2 are supplied with base current through the corresponding base resistors 6*a* and 6*b* alone. Since, however, the base resistors 6*a* and 6*b* are previously so arranged as to supply insufficient base current to the transistors TR1 and TR2 for causing to discharge the lamp 8, the discharge lamp 8 is not put into operation. In other words, the transistors TR1 and TR2 are operated in the A class amplification region, and only an insufficient level of voltage for the start of the discharge lamp 8 is impressed across the electrodes f1 and f2. Therefore, the discharge lamp 8 commences minute discharge in accordance with the magnitude of the impressed voltage, brightening the proximity of the electrodes f1 and f2. This brightened condition shows that the effective life of the discharge lamp 8 has not been brought to an end, and also that the transistor inverter 1 is in operation. It is not always necessary to arrange for the above-mentioned minute discharge. A prescribed length of time after the close of the switch 2, the switch 15 is thrown in. Since, at this time, the diode 13 supplies base current of prescribed level to the bases of the transistors TR1 and TR2, their operation is shifted from the A class amplification to switching operation. As a result, the transistor inverter 1 supplies an output voltage having a prescribed level between the electrodes f1 and f2 of the discharge lamp 8 through the transformer 5. The electrodes f1 and f2 which are fully preheated during the aforesaid specified period are not damaged when the discharge lamp 8 begins to be lighted. Since, after the start of the discharge lamp 8, base current continues to be supplied to the transistors TR1 and TR2, the discharge lamp 8 remains lighted under a stable condition. With the first embodiment of FIG. 1, immediately after the close of the switch 2, the transistors TR1 and TR2 are only supplied with base current having a low level limited by the resistors 6*a* and 6*b*. After the throw-in of the switch 15, however, the transistors TR1 and TR2 are supplied with the aforesaid base current of low level overlapping a base current delivered from the diode 13. In other words, the level of the base current is stepwise varied.

There will now be described the arrangement and operation of an apparatus shown in FIG. 2 according to the second embodiment of this invention. The base-emitter circuit of the transistor TR1 is connected between the input terminals T1 and T2 through first and second base resistors 20 and 21 and the inductor 3. The base-emitter circuit of the transistor TR2 is connected between the input terminals T1 and T2 through the first base resistor 20 and a third base resistor 22 (having the same resistance as the second base resistor 21). A switch 23 is provided to short-circuit the first base resistor 20, thereby eliminating the base current control circuit 12 of FIG. 1. The parts of FIG. 2 the same as those of FIG. 1 are denoted by the same numerals, description thereof being omitted.

When the switch 2 is thrown in, a base current flowing through the transistor TR1 is limited by the resistances of the resistors 20 and 21, and a base current conducted through the transistor TR2 is limited by the resistances of the resistors 20 and 22. If therefore, the overall resistance of the resistors 20 and 21 and the overall resistance of the resistors 20 and 22 are previously set at a proper level, then it is possible, as in the first embodiment of FIG. 1, to limit a voltage impressed across the electrodes f1 and f2 during the period of their preheating to a proper level. Where the switch 23 is thrown in after the close of the switch 2, then the base currents of the transistors TR1 and TR2 are respectively stepwise increased to the levels controlled by the resistances of the resistors 21 and 22. If, therefore, the resistances of the resistors 21 and 22 are preset at a prescribed level, then it is possible to start the discharge lamp by impressing a necessary starting voltage across the electrodes f1 and f2, after they are preheated for a specified length of time. While the switch 23 remains closed, the diacharge lamp 8 continues to be lighted. With second embodiment of FIG. 2, the base current control circuit 12*a* is formed of the first resistor 20 and switch 23.

Figure 3:
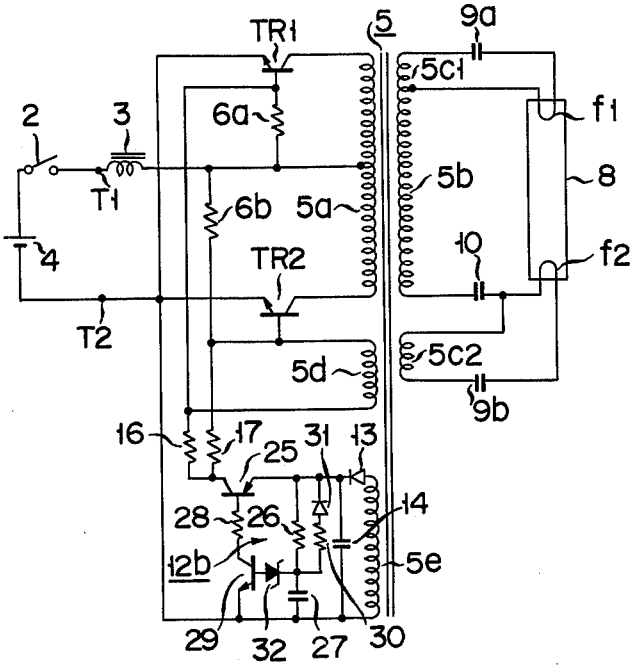

Referring to the third embodiment of FIG. 3, the base current control circuit 12*b* replaces that of FIG. 1. According to the third embodiment, the base current is stepwise increased in a prescribed length of time after the close of the switch 2. The base current control circuit 12*b* comprises a rectifier including winding 5*e*, diode 13 and capacitor 14; a PNP switching transistor 25 whose emitter is connected to the positive pole of the rectifier; a time constant circuit which includes a resistor 26 and capacitor 27 and is connected between the output terminals of the rectifier; a resistor 28 and another switching transistor 29 connected in series between the base of the switching transistor 25 and the negative pole of the rectifier; a Zener diode 32 connected with the indicated polarity between the junction of the resistor 26 and capacitor 27 on one hand and the base of the switching transistor 29 on the other; and a resistor 30 and diode 31 having the indicated polarity and connected in series between the junction of the resistor 26 and capacitor 27 on one hand and the positive pole of the rectifier on the other. The collector of the switching transistor 25 is connected to the bases of the transistors TR1 and TR2 through the corresponding resistors 16 and 17.

Figure 2:
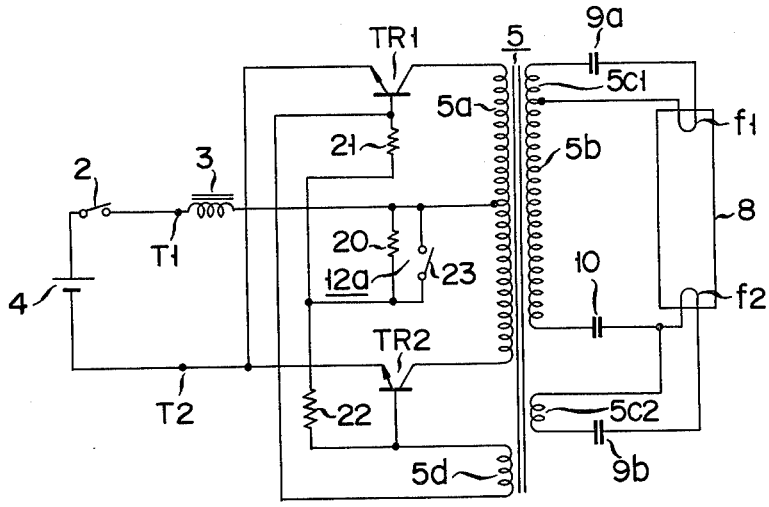

Since, after the close of the switch 2, the bases of the transistors TR1 and TR2 are respectively supplied with base currents limited by the resistances of the corresponding resistors 6*a* and 6*b*, only such voltage as is insufficient to carry out the discharge of the discharge lamp 8 is produced between both ends of the winding 5*b*, as in the first and second embodiments of FIGS. 1 and 2. The base current control circuit 12*b* is operated in the following manner. When the switch 2 is thrown in, the capacitor 27 of the time constant circuit begins to be charged with electric energy. After a prescribed length of time defined by the time constant circuit, a voltage impressed between the terminals of the capacitor 27 reaches a prescribed level. At this time, the switching transistor 29 and then switching transistor 25 are rendered conducting. Where, therefore, a prescribed period of time defined by the time constant circuit has passed after the close of the switch 2, the transistors TR1 and TR2 are supplied with base current delivered from the rectifier, thereby causing the discharge lamp 8 to be lighted. The series circuit of the resistor 30 and diode 31 is used to discharge electric energy stored in the capacitor 27. Obviously, the aforesaid prescribed period of time can be freely defined by the time constant of the time constant circuit or the selected voltage level of the Zener diode 32.

Figure 4:
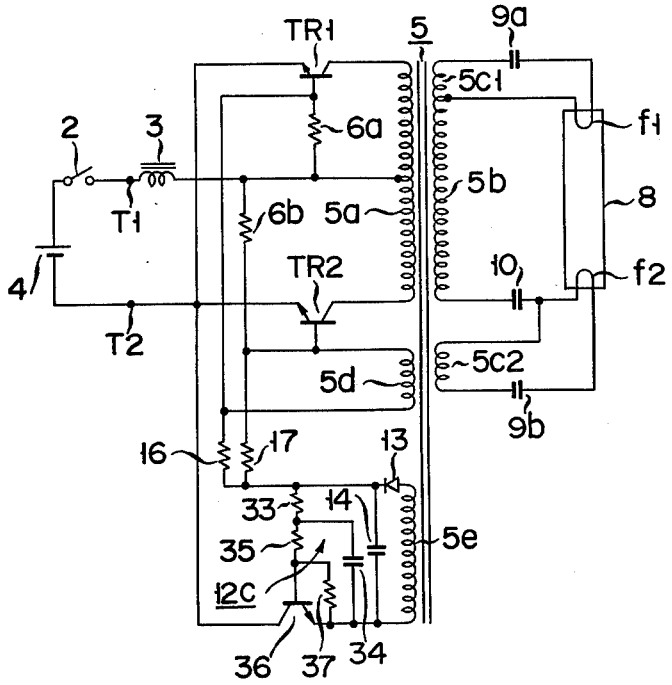
Figure 5:
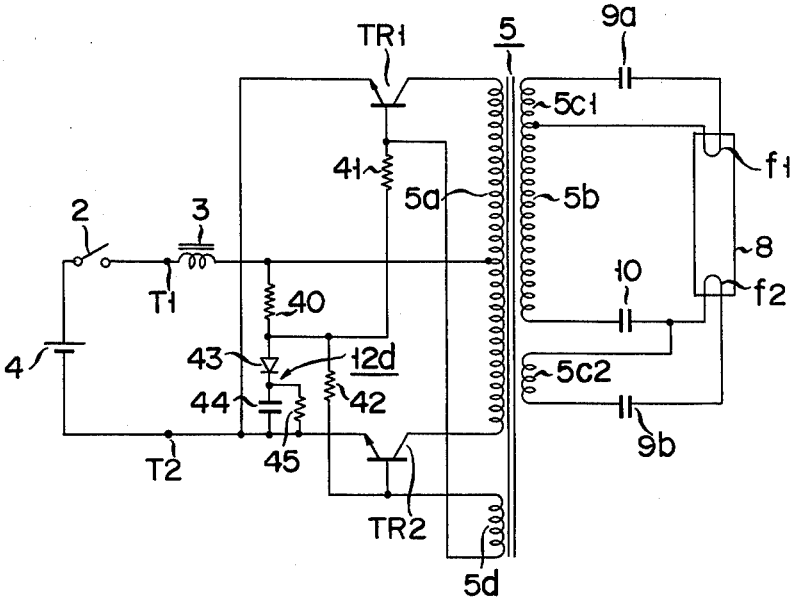
Figure 6:
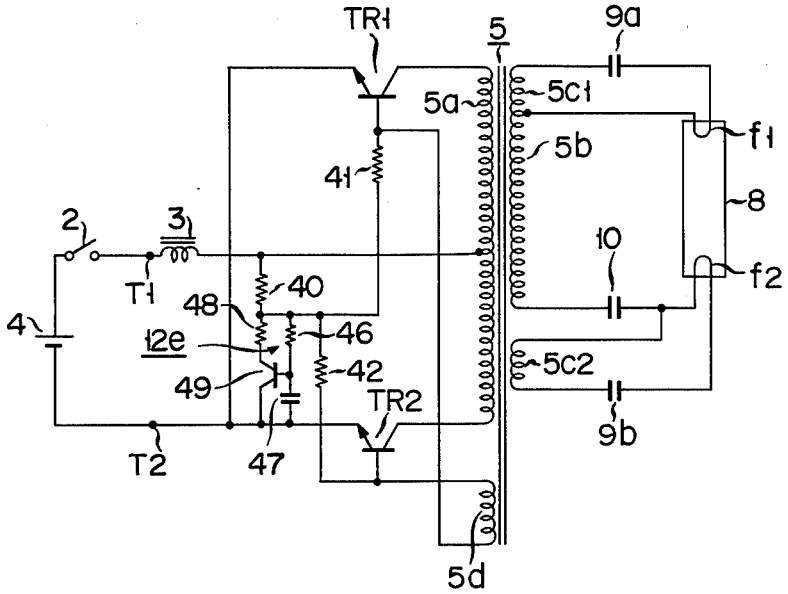

With the apparatus shown in FIGS. 4 to 6 according to the fourth to the sixth embodiments of this invention, base current supplied to the bases of the transistors TR1 and TR2 immediately after the close of the switch 2 is continuously increased during a prescribed period of time up to the level enabling the discharge lamp 8 to be started and lighted.

The parts of the apparatus of FIG. 4 according to the fourth embodiment (except for the base current control circuit 12*c*) the same as those of FIG. 3 are denoted by the same numerals, discription thereof being omitted. The base current control circuit 12*c* comprises a rectifier including the winding 5*e*, diode 13, and capacitor 14; a time constant circuit which includes a resistor 33 and capacitor 34 and is connected between both out terminals of the rectifier; an NPN transistor 36 whose emitter is connected to the negative pole of the rectifier, whose collector is connected to the input terminal T2 of the transistor inverter 1 and whose base is connected to the junction of the resistor 33 and capacitor 34 through a resistor 35; and a resistor 37 connected to the base of the NPN transistor 36 and also to the negative pole of the rectifier. As in the third embodiment of FIG. 3, an output from the rectifier is supplied as hase current to the transistors TR1 and TR2 through the corresponding resistors 16 and 17. At the close of the switch 2, the base current supplied to the transistors TR1 and TR2 is restricted to a level lower than the prescribed level capable of lighting the discharge lamp 8 by the resistances of the corresponding resistors 6*a* and 6*b*. Since, after the close of the switch 2, voltage impressed between both terminals of the capacitor 34 progressively rises, the base current supplied to the transistor 36 is also gradually increased, thus causing the transistor 36 to be rendered conducting at a progressively increased rate. As a result, the base current supplied to the bases of the transistors TR1 and TR2 is also gradually increased. After a prescribed period of time defined by the time constant of the time constant circuit having the resistor 33 and capacitor 34, the base current of the transistor 36 is held at a prescribed level. Therefore, the base currents of transistors TR1 and TR2 are also held at a prescribed level. If arrangement is made for the discharge lamp 8 to be lighted when the base current of the transistors TR1 and TR2 is fixed at the prescribed level, then the discharge lamp 8 can be lighted when the electrodes f1 and f2 are fully preheated.

Referring to the fifth embodiment of FIG. 5, the base resistor of the transistor TR1 is formed of first and second units 40 and 41. The base resistor of the transistor TR2 consists of the first resistor unit 40 and a second resistor unit 42. The base current control circuit 12*d* comprises a time constant circuit which consists of a series circuit including the first resistor unit 40, diode 43 and capacitor 44 and is connected between the input terminals T1 and T2 of the transistor inverter 1, and a discharge register 45 connected between both terminals of the capacitor 44. As seen from FIG. 5, a voltage impressed between the anode of the diode 43 and the input terminal T2 is supplied through the second resistor circuit 41 to the base-emitter circuit of the transistor TR1, and through to resistor 42 to the base-emitter circuit of the transistor TR1.

Since, immediately after the close of the switch 2, a voltage impressed between both terminals of the capacitor 44 has a low level, in other words, a large voltage drop occurs in the first resistor unit 40, the base current supplied to the transistors TR1 and TR2 has a low level. During a prescribed length of time, the capacitor 44 is progressively charged. Voltage impressed between both terminals of the capacitor 44 is gradually increased. In other words, a voltage drop in the first resistor unit 40 is slowly reduced, causing the base current of the transistors TR1 and TR2 to rise continuously. Since, after a prescribed period of time, voltage impressed between both terminals of the capacitor 44 stands at a fixed level, the base current of the transistors TR1 and TR2 remains fixed. When the level of the base current is brought to a fixed level, the discharge lamp 8 begins to be lighted and is held in this state.

The sixth embodiment of FIG. 6, except for the base current control circuit 12*e*, has substantially the same circuit arrangement as the fifth embodiment of FIG. 5. The parts of FIG. 6 the same as those of FIG. 5 are denoted by the same numerals, description thereof being omitted. The base current control circuit 12*e* comprises a time constant circuit including the resistors 40 and 46 and capacitor 47; and a PNP transistor 49 which is connected in parallel to a series circuit of the resistor 46 and capacitor 47 through a resistor 48, and whose base is connected to the junction of the resistor 46 and capacitor 47.

Since, at the close of the switch 2, a voltage impressed between both terminals of the capacitor 47 has a low level, a transistor 49 is rendered conducting, and a large voltage drop occurs in the first resistor unit 40. Accordingly, the transistors TR1 and TR2 are only supplied with a base current having a low level. Since, during a prescribed period of time, a voltage impressed between both terminals of the capacitor 47 is gradually increased, the transistor 49 is rendered conducting at a progressively decreasing rate, leading to a similar voltage drop in the resistor 40. As a result, a base current supplied to the transistors TR1 and TR2 continuously increases. After the aforesaid prescribed period of time, the level of a voltage impressed between both terminals of the capacitor 47, the conduction rate of the transistor 49, the extent of a voltage drop in the resistor 40, and the level of the base current of the transistors TR1 and TR2 are all fixed. The discharge lamp 8 continues to be lighted under the condition in which the base current is kept constant.

There will now be described the experiments made with a discharge lamp-operating apparatus. In these experiments, a filament preheat type 40 W discharge lamp was intermittently lighted 1500 times at an interval of 30 seconds, using the operating apparatus of this invention and the known operating apparatus provided with a lighting tube. Comparison was made between the blackened condition of the end portions of respective discharge lamps when operated by the operating apparatus of this invention and that of the discharge lamp when lighted by the known apparatus. With the operating apparatus of this invention, the push-pull type transistor inverter of FIGS. 1 to 6 was used. During a prescribed period of (1.2 sec), the base current of the respective inverter transistors was set at 4 mA, and, after the period, was stepwise increased to 50 mA. After the operating experiment was repeated 1500 times as described above, observation was made of the blackened condition of the end portions of the above-mentioned discharge lamp. When the discharge lamp was operated by the operating apparatus of this invention, the end portions of the discharge lamp were little blackened. In contrast, when the discharge was operated by the prior art operating apparatus provided with a lighting tube, then blackening was clearly observed on the inner walls of the end portions of the discharge lamp, the length of the blacked portions being 3 to 4 cm. With the discharge lamp, whose end portions were blackened, the electrodes (the electrode is coated with a material which elevates the emission of electrons) were obviously depleted. Where the operating apparatus of this invention was used, the frequency of an output from the inverter transformer was 17.7 KHz when no load was applied, that is, when a discharge lamp was not loaded, and 30 KHz when a load was applied, that is, when the discharge lamp was lighted. The voltage of an output from the inverter transformer was 290 V when no load was applied, and 140 V during the control of a base current. The discharge lamp was started with 260 V.

The rated current of the discharge lamp was 0.435 A and the rated tube voltage thereof was 102 V. The electrode current or filament current was about 0.8 to 1A (preheat current) during the aforesaid prescribed period, and about 0.25 A after the lighting of the discharge lamp. What deserves notice in this case is that the starting voltage was 160 V when the discharge lamp was lighted by the prior art operating apparatus provided with a lighting tube, whereas this invention used a high frequency starting voltage of about 260 V, and yet where the operating apparatus embodying the invention was applied, substantially no blackening appeared in the end portions of the discharge lamp.

The previously described transistor inverter need not be limited to the push-pull type, but may be the type provided with a single transistor. The frequency of an output from said transistor inverter is not subject to any particular limitation. The D.C. power source may be replaced by the type obtained by rectifying the commercial alternating power. The base current control circuit allows for various modifications. It is possible to connect a plurality of discharge lamps to a single output transformer.

What we claim is:

1. An apparatus for operating a gaseous discharge lamp which comprises a D.C. power source; a transistor inverter which is provided with input terminals connected to the D.C. power source through a switch, an output transformer and at least one inverter transistor, the collector-emitter circuit of said inverter transistor being connected between one end of the primary winding of the output transformer and one of the input terminals of said transistor inverter; a discharge lamp energized by an output from the output transformer and provided with a pair of electrodes heated by part of said output; and base current control means which is coupled to the transistor inverter and holds the base current of the inverter transistor at a level lower than a first level capable of starting the discharge lamp by an output from the transformer for a specified length of time after the switch is closed, and, after lapse of said specified length of time, holds the base current of the inverter transistor at said first level.

2. The apparatus according to claim 1, wherein the base current control means comprises means which, during the prescribed length of time, holds the base current of the inverter transistor at a prescribed second level lower than the first level, and after said prescribed length of time, shifts stepwise said base current from the prescribed second level to the first level.

3. The apparatus according to claim 1, wherein the base current control means comprises means which, during the prescribed length of time, continuously increases the base current from a level which is obtained immediately after the close of said switch and which is lower than said first level up to said first level.

4. The apparatus according to claim 2, wherein the base current control means includes a rectifier for rectifying part of an output from the output transformer; the base current having the prescribed second level is supplied from the input terminals of the transistor inverter through a base resistor; the base current having the first level is formed of a mixture of a base current conducted from the rectifier to the inverter transistor after said prescribed length of time and the base current having the prescribed second level.

5. The apparatus according to claim 4, wherein the means for supplying the base current from the rectifier after the prescribed length of time is a switch connected between an output terminal of the rectifier and the base-emitter circuit of the inverter transistor.

6. The apparatus according to claim 4, wherein the means for delivering the base current from the rectifier after the prescribed length of time comprises a time constant circuit connected between the output terminals of the rectifier; a switching transistor connected between one of the output terminals of the rectifier and one of the terminals of the base-emitter circuit of the inverter transistor; and a circuit coupled to the time constant circuit and the switching transistor to operate said switching transistor after the prescribed length of time.

7. The apparatus according to claim 2, wherein the base current having the prescribed second level is delivered from the input terminal of the inverter through a base resistor; and the base current having the first level is sent forth from the input terminals by short-circuiting part of the base resistor after the prescribed length of time.

8. The apparatus according to claim 3, wherein the means for continuously increasing the base current of the inverter transistor comprises a transistor; a rectifier for rectifying part of an output from the output transformer and supplying the rectified output to the base-emitter circuit of the inverter transistor through said transistor; a time constant circuit connected to the output terminals of the rectifier; and a circuit coupled to the time constant circuit and the base of the transistor to control the base current of the transistor such that the transistor is rendered conducting at a progressing increasing rate during the prescribed length of time.

9. The apparatus according to claim 3, wherein the means for continuously increasing the base current of the inverter transistor during the prescribed length of time comprises a diode and capacitor connected in series between one end of the first base resistor unit of the inverter transistor, the other end of which is connected to one of the input terminals of the transistor inverter, and the other input terminal of said transistor inverter.

10. The apparatus according to claim 3, wherein the means for continuously increasing the base current of the inverter transistor comprises a transistor connected between one end of the first base resistor unit whose other end is connected to one of the input terminals of the transistor inverter and the other input terminal of said transistor inverter, and a time constant circuit connected between said one end of the first base resistor unit and the other input terminal of the transistor inverter and also coupled to the base of said transistor; and said transistor receives from the time constant circuit such base current as renders said transistor conducting at a progressively increasing rate during the prescribed length of time.

11. The apparatus according to claim 1, wherein the transistor inverter is a push-pull type including two inverter transistors.

* * * * *